US010501992B2

(12) United States Patent
Lindberg

(10) Patent No.: US 10,501,992 B2
(45) Date of Patent: Dec. 10, 2019

(54) DEVICE AND METHOD IN RESPECT OF A ROCK DRILL RIG, DRILL STRING COMPONENT, HANDLING DEVICE AND ROCK DRILL RIG

(71) Applicant: EPIROC ROCK DRILLS AKTIEBOLAG, Örebro (SE)

(72) Inventor: Rune Lindberg, Saltsjö-Boo (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 1135 days.

(21) Appl. No.: 14/651,517

(22) PCT Filed: Dec. 20, 2013

(86) PCT No.: PCT/SE2013/051583
§ 371 (c)(1),
(2) Date: Jun. 11, 2015

(87) PCT Pub. No.: WO2014/098758
PCT Pub. Date: Jun. 26, 2014

(65) Prior Publication Data

US 2015/0308192 A1 Oct. 29, 2015

(30) Foreign Application Priority Data

Dec. 21, 2012 (SE) ..... 1251486

(51) Int. Cl.
*E21B 7/02* (2006.01)
*E21B 19/084* (2006.01)

(52) U.S. Cl.
CPC ..... *E21B 7/025* (2013.01); *E21B 19/084* (2013.01)

(58) Field of Classification Search
CPC ..... E21B 7/02; E21B 7/025; E21B 19/084; E21B 19/086; B65G 57/04; B65G 23/00
(Continued)

(56) References Cited

U.S. PATENT DOCUMENTS 2,103,252 A 12/1937 Gartin
2,390,709 A * 12/1945 Henderson ..... E21B 19/084 173/147

(Continued)

FOREIGN PATENT DOCUMENTS

EP 1158287 A2 11/2001

OTHER PUBLICATIONS

PCT/ISA/210—International Search Report—dated Apr. 25, 2014 (Issued in Application No. PCT/SE2013/051583).

(Continued)

*Primary Examiner* — Alexander M Valvis
*Assistant Examiner* — Mary C Hibbert-Copeland
(74) *Attorney, Agent, or Firm* — Venable LLP; Jeffri A. Kaminski

(57) ABSTRACT

A tensioning device for a chain transmission for movement transfer between a driver device and a slide to be driven by a drive chain along a linear guide of a rock drill rig. A first fastening member fastens a first end of the drive chain on the slide. A second fastening member fastens a second end of the drive chain on a tensioning head, which is arranged displaceable in a tension direction of the drive chain on the slide. A spring device is arranged between the tensioning head and the slide for spring loading the tensioning head in the tension direction. At least one of the first and second fastening members includes an adjuster for adjusting tension in the drive chain. Also a method, a handling device and a rock drill rig.

10 Claims, 4 Drawing Sheets

(58) Field of Classification Search
USPC ..... 173/147, 145, 185, 49, 1, 111
See application file for complete search history.

(56) References Cited

U.S. PATENT DOCUMENTS

| | | | | |
|---|---|---|---|---|
| 2,795,301 | A | 6/1957 | Driver | |
| 3,684,035 | A | 8/1972 | Wills | |
| 4,303,132 | A | 12/1981 | Weber | |
| 5,303,549 | A * | 4/1994 | Berchtold | B23Q 11/001 60/414 |
| 5,941,324 | A | 8/1999 | Bennett | |
| 2003/0122421 | A1 * | 7/2003 | Hoff | B62D 55/30 305/144 |
| 2005/0187053 | A1 | 8/2005 | Kim | |

OTHER PUBLICATIONS

PCT/ISA/237—Written Opinion of the International Searching Authority—dated Apr. 25, 2014 Issued in Application No. PCT/SE2013/051583).

PCT/IPER/409—International Preliminary Report on Patentability—dated Apr. 24, 2015 Issued in Application No. PCT/SE2013/051583).

* cited by examiner

DEVICE AND METHOD IN RESPECT OF A ROCK DRILL RIG, DRILL STRING COMPONENT, HANDLING DEVICE AND ROCK DRILL RIG

CROSS-REFERENCE TO RELATED APPLICATIONS

The application claims priority to Swedish patent application 1251486-5 filed 21 Dec. 2012 is the national phase under 35 U.S.C. § 371 of PCT/SE2013/051583 filed 20 Dec. 2013.

FIELD OF THE INVENTION

The present invention relates to a tensioning device for a chain transmission for movement transfer between a driver device and a slide to be driven by a drive chain along a linear guide of a rock drill rig. The invention also relates to a method for tensioning a chain transmission, a handing device for handling drill string components in a rock drill rig and a rock drill rig.

BACKGROUND OF THE INVENTION

In a previously known rock drill rig, the rock drilling machine is fastened to a slide being movable to and fro on a feed beam. The transfer of movement from a drive motor to the slide is over a chain transmission which is fastened to the slide.

Because of wear, the drive chain will experience a successive elongation during operation which is the reason for proposals of different arrangements for tensioning the drive chain. Hereby pressing means are previously known that press laterally against a part of the chain with a certain force in order to absorb slack in the drive chain. Another previously known chain tensioning mechanism is comprised of a displacement device for a wheel being arranged in the chain transmission.

AIM AND MOST IMPORTANT FEATURES OF THE INVENTION

An aim of the present invention is to provide a tensioning device as indicated above which comprises a secure and economic further development of tensioning devices for a drive chain in a rock drill rig.

This aim is obtained through the invention in tensioning device as above through a first fastening member for fastening a first end of the drive chain on the slide, and a second fastening member for fastening a second end of the drive chain on a tensioning head which is arranged displaceable in a tension direction of the drive chain on the slide, wherein a spring device is arranged between the tensioning head and the slide for spring loading the tensioning head in the tension direction, and wherein at least one of said first and second fastening members includes adjustment means for adjusting tension in the drive chain.

Hereby it is made possible to provide a desired tension in the chain with simple measures through the combination of said spring device and adjustment device. When these elements are arranged on the slide itself, no particular specialized measures have to be taken that influence the path of the drive chain or the chain transmission itself. The slide can be constructed such that the related elements can be made easy to inspect, adjust and, when required, maintain.

It is preferred that the tensioning head moves on a slide guide being oriented in said tension direction. It is preferred in particular that the slide guide includes two parallel slide rods which pass through bushings being received in the tensioning head.

For i.a. space saving and guiding reasons it is suitable that the spring device includes a pressure spring package arranged around each slide rod. Also other resilient elements are, however, possible to use. Preferably a movement limiter is arranged between the tensioning head and the slide for preventing excessive compression of the spring device.

In a preferred variant of the invention an indirect chain tension sensor is arranged to sense a relative position between the slide and the tensioning head. Through this arrangement a device is realized which in a simple way can verify the presence of adequate drive chain tension.

The indirect chain tension sensor is suitably a sensor from the group: an inductive sensor, a capacitive sensor, a mechanical sensor, a Hall sensor, an optical sensor.

It is preferred that the chain tension sensor is positioned on the slide and that a detectable element intended for detection is positioned on the tensioning head. The reverse positioning is, however, also possible.

According to a preferred aspect of the invention a safety brake is fastened on the slide. This safety brake is in case of chain tension below a determined level arranged to brake the slide through braking engagement with a brake surface extending along the linear guide at for example detected chain tension below a determined level.

It is not excluded that it is possible also to detect a speed of movement of the slide in respect of the linear guide and that a detected speed above a certain level initiate braking of the slide. This can be valuable for increasing safety in case of intact drive chain but failing chain motor or the like.

All together this aspect results in enhanced security for an operator and for other persons in the vicinity of the rig, since the risk of gripping device and drill string components falling are at least considerably reduced.

It is preferred that the security brake is a hydro-mechanical, normally locked clamping brake and that the brake surface is arranged on an elongated brake beam which is arranged adjacent to the linear guide. Hereby the safety brake can be made active at the absence of pressure in a control conduit, resulting in safety, since the brake does not have to be actively controlled for braking.

It shall be noted that tensioning the drive chain is performed in a main direction of the drive chain in the region of the slide, said direction being "tension direction S". This main direction is parallel to a movement direction of the slide.

In an inventive method for tensioning a chain transmission for movement transfer between a driver device and a slide to be driven by a drive chain along a linear guide of a rock drill rig, a first end of the drive chain is fastened to the slide through a first fastening member, and a second end of the drive chain is fastened through a second fastening member on a tensioning head which is displaced in a tension direction of the drive chain on the slide, wherein the tensioning head is spring loaded in the tension direction through a spring device being arranged between the tensioning head and the slide, and wherein tension in the drive chain is adjusted through adjustment means being included in at least one of said first and second fastening members.

Method features corresponding to the above device features related to variants of the tensioning device are applicable also in respect of variants of the inventive method.

An inventive handling device for handling drill string components in a rock drill rig, wherein the handling device exhibits a linear guide with a slide being displaceable by a chain transmission and a gripping device for drill string components being positioned on the slide is distinguished in that the handling device includes a tensioning device according to the above.

An inventive rock drill rig including a linear guide in the form of a feed beam with a slide being displaceable by a chain transmission and a rock drilling machine being positioned on the slide is distinguished in that the rock drill rig includes a tensioning device according to the above.

The invention will now be described in greater detail by way of embodiments and with reference to the drawings.

DESCRIPTION OF EMBODIMENTS

Figure 1:
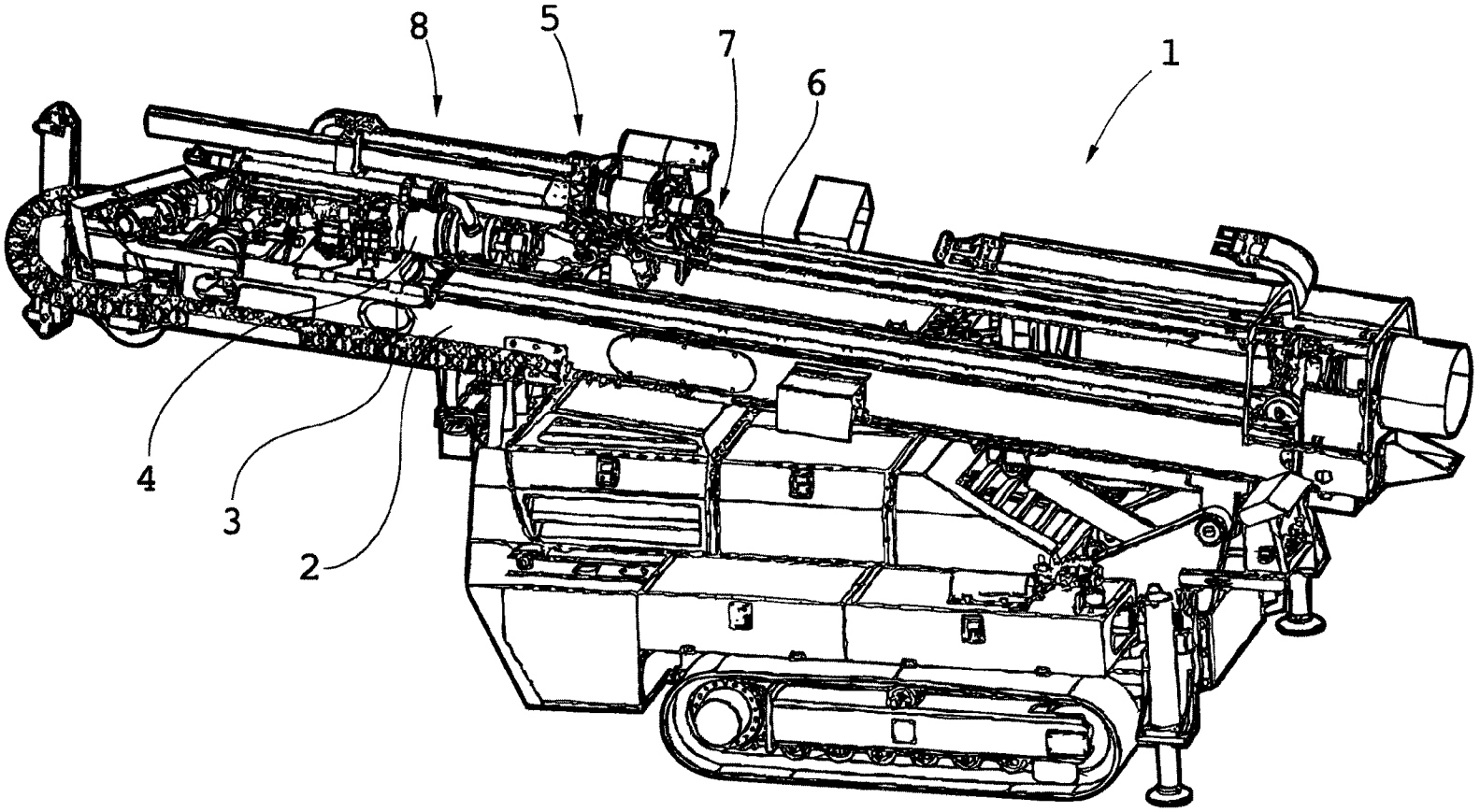
FIG. 1 diagrammatically a rock drill rig equipped with a feed beam for a rock drilling machine and a linear guide for a device for handling drill string components.

FIG. 1 shows diagrammatically a rock drill rig 1, which is equipped with a feed beam 2 whereon a (drilling machine) slide 3 supporting a rock drilling machine 4 is movable to and fro. On the feed beam 2 there is fastened a device 5 for handling drill string components including a linear guide 6 whereon a (handling) slide 7 with a gripping device 8 is movable to and fro.

The device for handling drill string components 5 is arranged to handle drill string components being stored in a magazine (not shown) for drill string components close to the rock drill rig and to successively position them in a drill string position of the rock drilling machine 4. The device for handling drill string components 5 is also arranged to successively remove drill string components from the drill string position and place them in said magazine when the drill string is taken out from a bore hole, for example when it is time to replace the drill bit.

Figure 2:
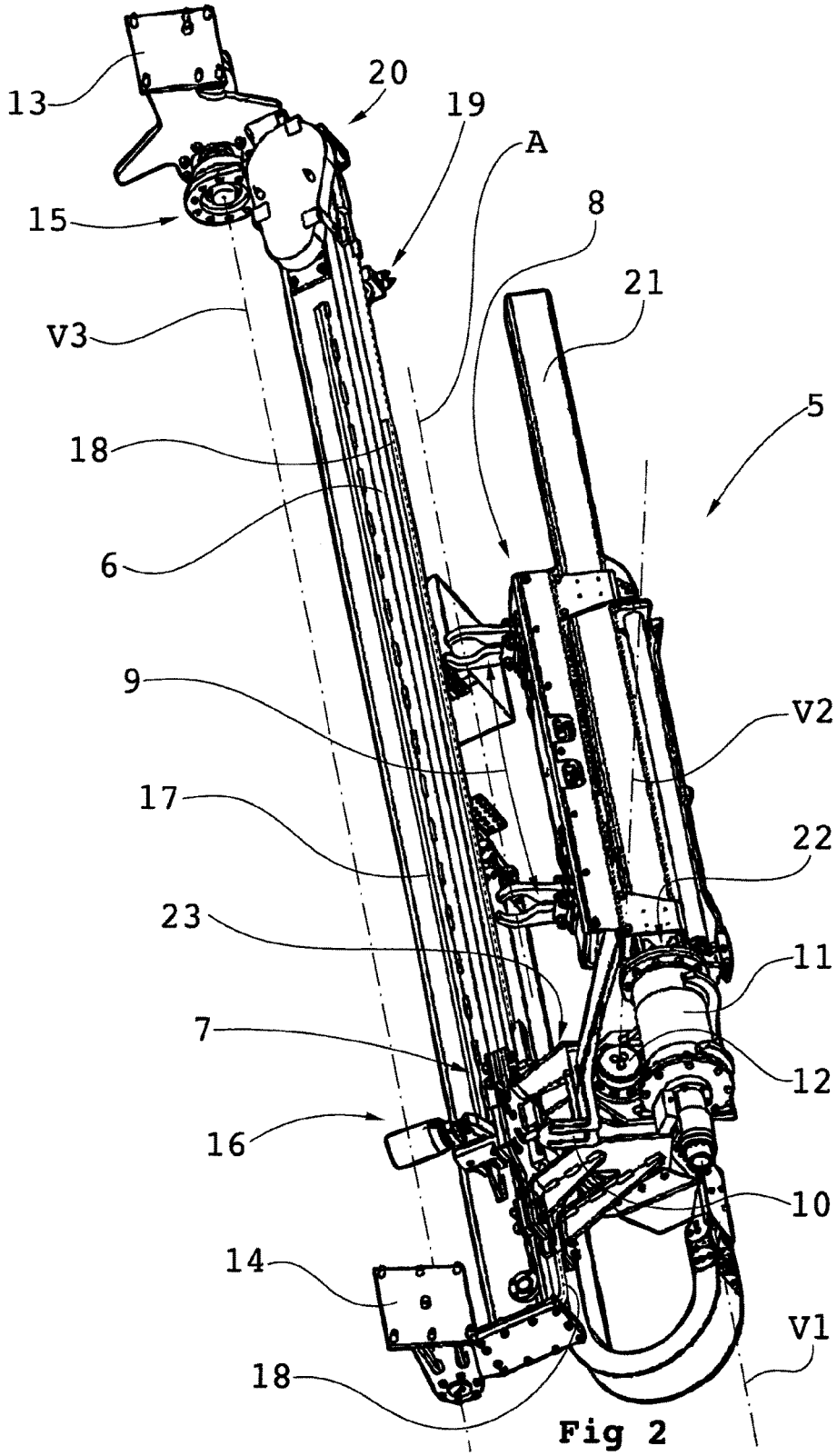
FIG. 2 shows the device for handling drill string components in FIG. 1 made free from the feed beam and in greater scale.

In FIG. 2, the linear guide 6 is shown and the to and fro movable slide 7, whereon is attached the gripping device 8. The gripping device 8 is movable in respect of the slide 7 through a first rotator 11 which has a first rotational axis V1, and through a second rotator 12 around a second rotational axis V2. The gripping device 8 has to pairs of grippers 9 said pairs being axially separated, as seen from a gripped drill string component. The gripping device 8 also comprises an axial stop 10 for a gripped drill string component.

The device 5 for handling drill string components is attached to the feed beam of a rock drill rig over the first fastening device 13 and a second fastening device 14. The linear guide 6 with supported slide 7 is pivotal in respect of the fastening devices 13 and 14 and to the feed beam by a third rotator 15 around a third rotational axis V3.

The slide 7 is further equipped with a safety brake 16 which co-operates with a brake beam 17 being arranged along the linear guide 6 and being provided with a brake surface on each side. The safety brake 16 is in the shown example a normally locked clamping brake which in unloaded condition clamps on the brake beam 17 such that the slide 7 with associated gripping device 8 is locked in respect of the linear guide for preventing that the slide with the gripping device, possibly with gripped, heavy drill string component, falls to a lowermost position, whereby serious risks for injury on the operator and possible other persons in the vicinity could occur.

The slide also has other means for co-operation with a drive chain, which is indicated with interrupted lines at 18.

This drive chain is driven by a driver device 19 partly being shown in FIG. 2, for a movement to and fro of the slide 7 along the linear guide 6. The drive chain is positioned in a loop so that it co-operates with a driver device 19 over a drive transmission 20 and a not shown freely rotatable chain wheel positioned at the lower part of the linear guide 6, as it is shown in FIG. 2.

Figure 3:
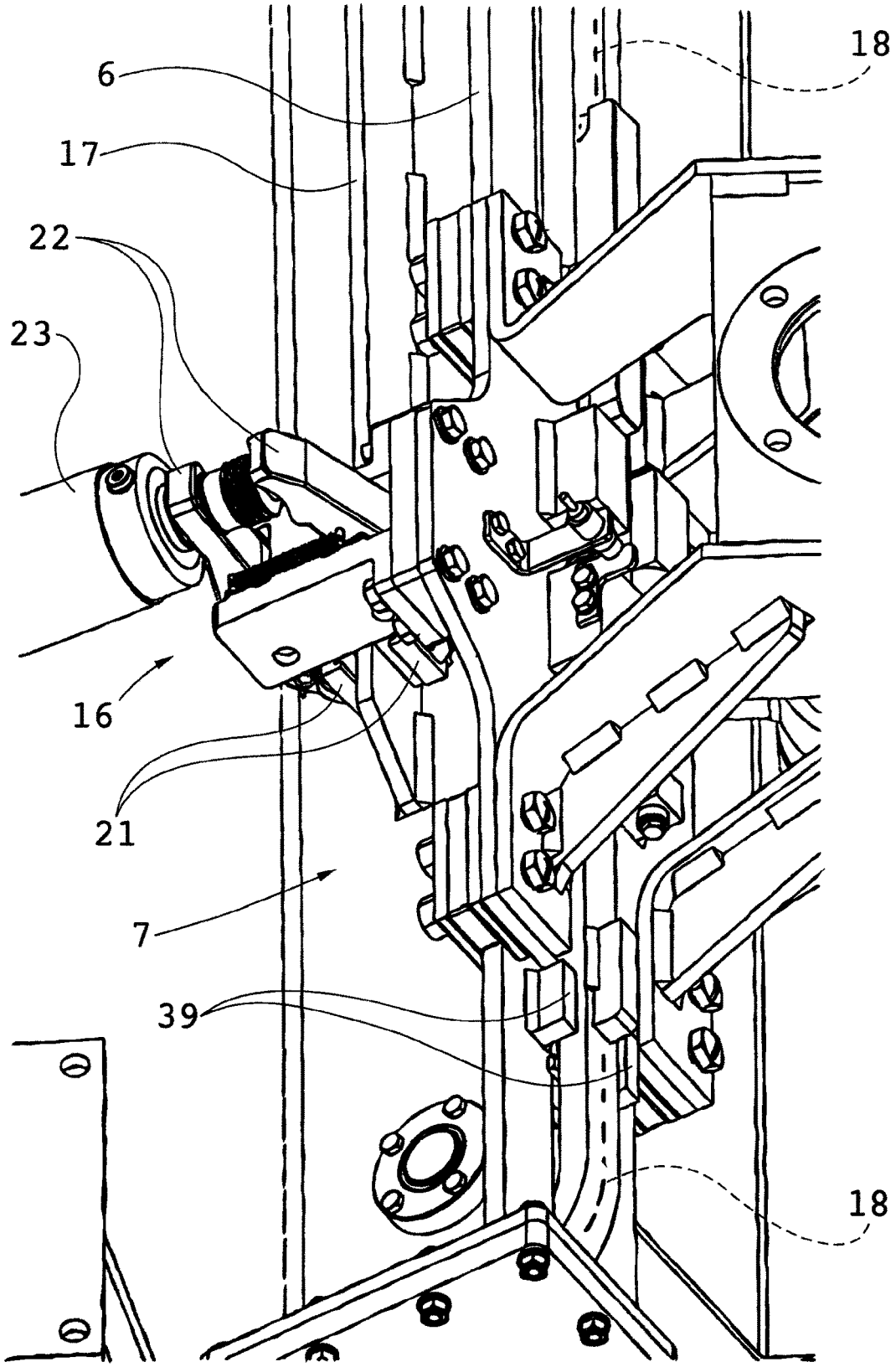
FIG. 3 shows an enlarged view of a detail of a device for handling drill string components in greater scale.

FIG. 3 shows the safety brake 6 in greater scale. The safety brake 16 includes a brake actuator 23, which manoeuvres two clamping blocks 21 each one being supported by a clamp arm 22. The brake actuator 23 is preferably a hydromechanical actuator device which opens the clamping blocks 21 at a determined incoming hydraulic pressure. In case of absence of an incoming hydraulic pressure at a determined pressure level, an enclosed pressure spring package presses the clamp arms 22 apart in the region of the brake actuator such that the clamping blocks 21 clamp against the brake beam 17 for braking/locking the slide 7.

39 indicates stop lugs for an end position of the slide 7 on the linear guide 6.

Figure 4:
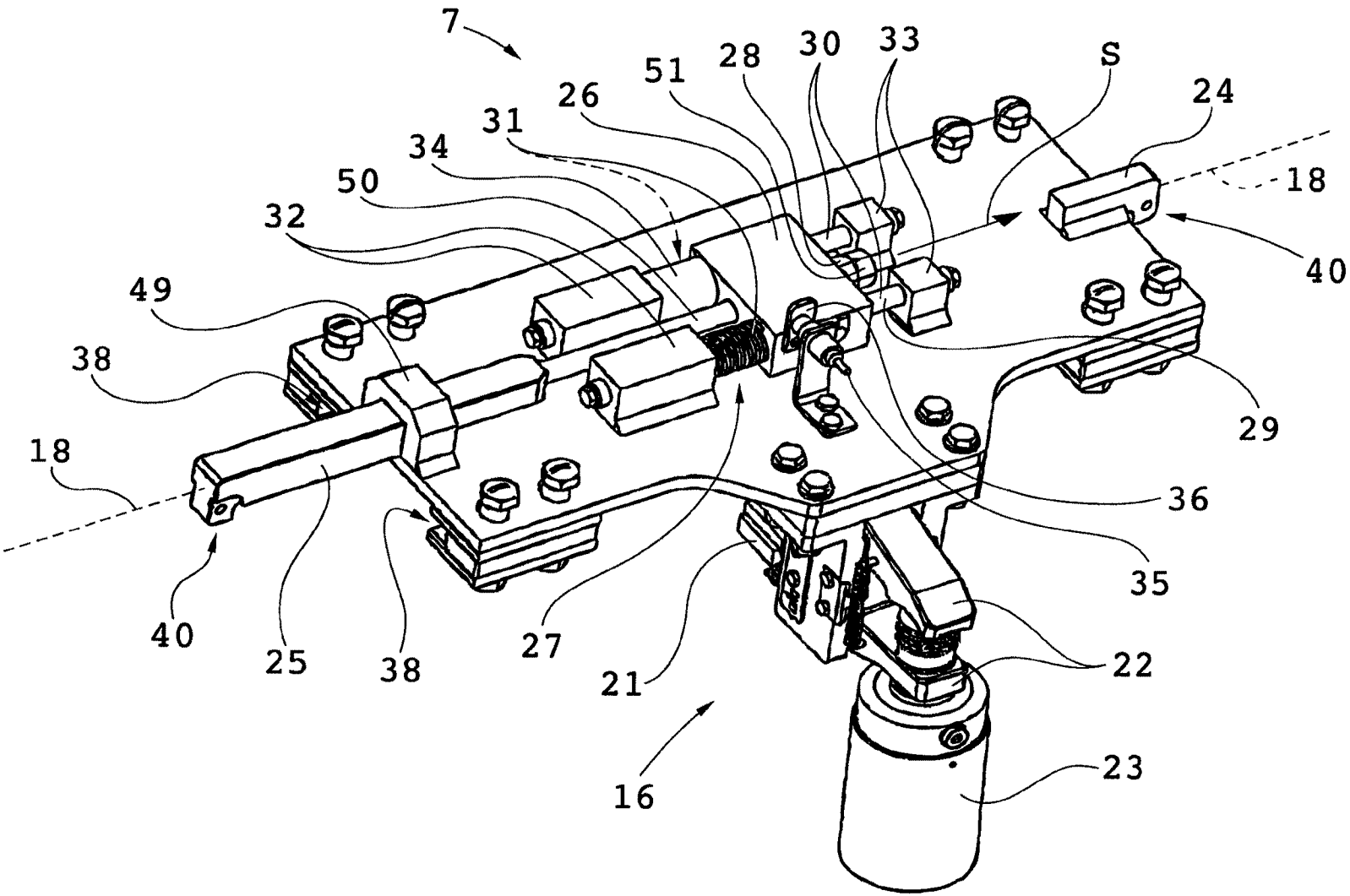
FIG. 4 shows the slide of said device for handling drill string components made free from other components.

In FIG. 4 the slide 7 is shown isolated from other components, and on a first end part of the slide 7 there is arranged a first fastening member 24 for the fastening said drive chain 18. At an opposite end part of the slide 7, there is arranged a second fastening member 25 for the co-operation with the other end of the drive chain 18.

The first fastening member 24 is in the shown embodiment rigidly fastened to the slide 7 whereas the second fastening member 25 co-operates with the slide 7 over a tensioning arrangement which will be described in the following.

Said second fastening member 25 is most distally provided with engagement means 40 for said drive chain 18. The second fastening member 25 is movable in a tension direction S in respect of the slide 7 which provides a guide 49 allowing a movement in said direction S. On a proximal end, turned inwardly towards the slide 7, the second fastening member is provided with a rod 50, which passes through a movable tensioning head 26.

The tensioning head 26 is movable, likewise in said direction S in respect of the slide 7, through the co-operation of not shown bushings being received in the tensioning head, with a slide guide 29 in the form of two parallel sliding rods 30. The rod 50 protrudes with its proximal end at an opposite end of the tensioning head 26 in respect of the engagement means 40 of the second fastening member 25 and is in this area threaded for the co-operation with one adjustment nut 51 (or more adjustment nuts 51) in order together to form adjustment means 28 for manual adjustment of the tension in the drive chain 18.

The tensioning head 26 is further spring preloaded in a direction in parallel to said tension direction S by way of a spring device 27 being comprised of a two pressure spring packages 31. Each pressure spring package includes in the shown embodiments a pressure spring (only one shown on FIG. 4), each one surrounding the respective sliding rod 30.

Around each pressure spring, which is formed of a cylindrical helix-shaped spring, there is arranged a surrounding sleeve 34 (only one is shown in FIG. 4), forming a stop of the tensioning head in a direction opposite to said tension direction S. When the drive chain is to be tensioned to a desired chain tension, the nut of the adjustment means 28 is tightened on the rod being connected to the second fastening member until the tensioning head 26 just has come to an abutment against an end surface of said movement limiter in the form of the surrounding sleeve 34.

35 indicates an indirect chain tension sensor which is rigidly connected to the slide 7 whereas 36 indicates a detectable element being firmly connected to the tensioning head 26.

In case of wear in the chain resulting in chain elongation, the tensioning head 26 will be displaced in said tension direction S in respect of the slide 7, whereby the chain tension sensor 35 will be able to sense absence of proximity to the detectable element 36. Hereby a signal can be emitted over a circuit being connected to the chain tension sensor 35 said circuit and preferably being part of the control system of the rock drill rig.

The signal can be a light or a sound signal or be an electrical signal to a control circuit or the like. The signal can also advantageously be combined with a signal for interruption of hydraulic fluid supply to the above mentioned security brake 16 so as thereby to initiate clamping of the clamping blocks 21 against the brake beam 17 shown in FIG. 2 for braking/locking in the present position.

The same will occur in case of chain breakage, i.e. that the chain tension sensor 35 indicates absence of proximity to the detectable element 36, whereby a warning signal respectively locking of the slide 7 in respect of the linear guide 6 and the brake beam 17 will be initiated.

On FIG. 4 there are shown slide surfaces 38 on the slide 7 for co-operation with a linear guide 6. Also otherwise constructed slide bearing or the like can be arranged for displacement co-operation between the slide 7 and the linear guide.

Figure 5:
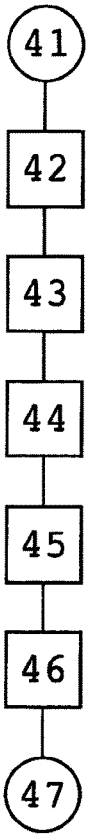
FIG. 5 shows diagrammatically a block diagram of a sequence of a method according to the invention.

FIG. 5 shows a block diagram of a sequence of a method according to the invention, wherein:

Position 41 indicates the start of the sequence.

Position 42 indicates that the tensioning head is spring loaded by a spring device between the tensioning head and the slide.

Position 43 indicates that the tension of the drive chain is adjusted through adjustment means.

Position 44 indicates that the relative position between the slide and the tensioning head is detected by an indirect chain tension sensor.

Position 45 indicates that in case of detected chain tension below a determined level, a signal is emitted.

Position 46 indicates that based on said signal, a safety brake on the slide brakes the slide.

Position 47 indicates the end of the sequence.

After action of the safety brake, the cause is controlled. Is the reason only insufficient chain tension in spite of faultless drive chain quality, it is normally sufficient to tension the chain. Is the reason that the drive chain is too worn or that it is broken, it has to be replaced.

The invention can be modified within the scope of the following claims. It can thus be arranged that the second fastening member 25 is rigidly connected to the tensioning head 26 whereas the first fastening member includes adjustment means corresponding to the adjustment means 28 on FIG. 4.

The adjustment means 28 for manual adjustment of tension in the drive chain 18 can be replaced with motorized adjustment means for adjusting the tension in the drive chain 18. Such motorized adjustment means can be controlled with the aid of signals from an operator but also be automatic and be controlled by signals from a chain tension sensor.

The invention is applicable for a handling device according to the above and also for a chain transmission of a slide for a rock drilling machine in respect of a feed beam of the rock drilling machine.

The invention claimed is:

1. A tensioning device for a chain transmission for movement transfer between a driver device and a slide to be driven by a drive chain along a linear guide of a rock drill rig, the tensioning device comprising:

a tensioning head arranged on the slide and being displaceable in relation to the slide in a tension direction of the drive chain, a first fastening member for fastening a first end of the drive chain on the slide, a second fastening member for fastening a second end of the drive chain on the tensioning head, a spring device arranged between the tensioning head and the slide for spring loading the tensioning head in the tension direction, a tension adjuster included with at least one of said first and second fastening members, wherein the tension adjuster is for adjusting tension in the drive chain, and a slide guide provided on the slide and on which the tensioning head moves in relation to the slide, wherein the slide guide is oriented in said tension direction, and wherein the slide guide includes two parallel slide rods which pass through bushings being received in the tensioning head.

2. The device according to claim 1, wherein the spring device includes a pressure spring package arranged around each slide rod.

3. The device according to claim 1, further comprising:

a movement limiter arranged between the tensioning head and the slide for preventing compression of the spring device.

4. The device according to claim 1, further comprising:

an indirect chain tension sensor arranged to sense a relative position between the slide and the tensioning head.

5. The device according to claim 4, wherein the chain tension sensor is a sensor from the group: an inductive sensor, a capacitive sensor, a mechanical sensor, a Hall sensor, or an optical sensor.

6. The device according to claim 4, wherein the chain tension sensor is positioned on the slide, the device further comprising:

a detectable element intended for detection positioned on the tensioning head.

7. The device according to claim 4, further comprising:

a safety brake fastened on the slide, said safety brake in case of chain tension below a determined level being arranged to brake the slide through braking engagement with a brake surface extending along the linear guide.

8. The device according to claim 7, wherein the safety brake is a hydro-mechanical normally locked clamping brake, and wherein the brake surface is arranged on an elongate brake beam being arranged adjacent to the linear guide.

9. A handling device for handling drill string components in a rock drill rig, the handling device comprising:

a linear guide, a slide, a chain transmission configured to displace the slide, a gripping device for drill string components being positioned on the slide, and a tensioning device comprising a tensioning head arranged on the slide and being displaceable in relation to the slide in a tension direction of the drive chain, a first fastening member for fastening a first end of the drive chain on the slide, a second fastening member for fastening a second end of the drive chain on the tensioning head, a spring device arranged between the tensioning head and the slide for spring loading the tensioning head in the tension direction, a tension adjuster included with at least one of said first and second fastening members, wherein the tension adjuster is for adjusting tension in the drive chain, and a slide guide provided on the slide and on which the tensioning head moves in relation to the slide, wherein the slide guide is oriented in said tension direction, and wherein the slide guide includes two parallel slide rods which pass through bushings being received in the tensioning head.

10. A rock drill rig, comprising:

a linear guide comprising a feed beam a slide, a chain transmission configured to displace the slide, a rock drilling machine positioned on the slide, and a tensioning device comprising a tensioning head arranged on the slide and being displaceable in relation to the slide in a tension direction of the drive chain, a first fastening member for fastening a first end of the drive chain on the slide, a second fastening member for fastening a second end of the drive chain on the tensioning head, a spring device arranged between the tensioning head and the slide for spring loading the tensioning head in the tension direction, a tension adjuster included with at least one of said first and second fastening members, wherein the tension adjuster is for adjusting tension in the drive chain, and a slide guide provided on the slide and on which the tensioning head moves in relation to the slide, wherein the slide guide is oriented in said tension direction, and wherein the slide guide includes two parallel slide rods which pass through bushings being received in the tensioning head.

* * * * *